United States Patent [19]

Knapp

[11] 4,279,458

[45] Jul. 21, 1981

[54] RELEASING ELECTRICAL CONNECTOR

[75] Inventor: Carl L. Knapp, Oneonta, N.Y.

[73] Assignee: The Bendix Corporation, Southfield, Mich.

[21] Appl. No.: 59,935

[22] Filed: Jul. 23, 1979

[51] Int. Cl.[3] ..... H01R 13/62

[52] U.S. Cl. ..... 339/45 M; 285/316

[58] Field of Search ..... 339/45 R, 45 M, 46, 339/89 R, 89 M, 89 C, 90 R, 90 C, 91 R, 91 B; 285/316; 85/51

[56] References Cited

U.S. PATENT DOCUMENTS

| | | | |
|---|---|---|---|
| 1,777,614 | 10/1930 | Hauger | 85/51 |
| 3,162,084 | 12/1964 | Wurzel | 85/51 |

FOREIGN PATENT DOCUMENTS

| | | | |
|---|---|---|---|
| 919353 | 2/1963 | United Kingdom | 339/89 M |
| 1104697 | 2/1968 | United Kingdom | 285/316 |

*Primary Examiner*—Neil Abrams

*Attorney, Agent, or Firm*—John R. Benefiel; Raymond J. Eifler; Charles D. Lacina

[57] ABSTRACT

A releasable electrical connector consisting of a connector plug mating with a corresponding connector receptacle which may be disconnected by a separating force applied to a surrounding operating sleeve and the connectorl receptacle. The operating sleeve is shifted axially by the separating force against the bias of compression springs to a release position. The springs are received within grooves formed along the exterior of a segmented spring retaining housing, the segments forming an anchoring flange disposed within a recess formed about the connector plug. A plurality of arcuate threaded coupling segments assembled within the operating sleeve provide a threaded coupling, which segments in the nonreleasing position of the operating sleeve are positioned radially inward to mate with a corresponding thread on the receptacle and serve to create a mating force between the receptacle and plug upon rotation of the operating sleeve and to retain the connector and plug in the connected position. In the releasing position of the operating sleeve, the arcuate coupling segments are moved radially outward into a pair of axially spaced recesses by a camming action occurring between the mating threads on the receptacle and segments to allow the release of the receptacle from the plug. Anti-vibration springs are provided on a plurality of arcuate segments which engage ratchet teeth formed on the exterior of the connector plug to prevent vibration-induced unthreading of the arcuate segments and plug.

9 Claims, 5 Drawing Figures

RELEASING ELECTRICAL CONNECTOR

BACKGROUND DISCUSSION

Releasing electrical connector designs have heretofore been employed which produce separation of the connector plug and a mating receptacle upon the application of a separating force. Such arrangements have included an operating sleeve mounted so that upon the application of a separating force, the operating sleeve is axially shifted which in turn produces a release of a retaining connection between the receptacle and plug.

The connection which secures the plug shell and the receptacle includes means which also provides the force for causing the receptacle and plug shell to be mated. This means has taken the form of a camming arrangement between a coupling member carried within the operating sleeve, on which is formed cam surfaces, such as threads or a bayonet connection which interact with cam surfaces formed on the receptacle to produce axial advancing movement of the receptacle into engagement with the plug shell by rotation of the operating sleeve and which retains the same upon achieving their connected relationship.

The movement of the operating sleeve produces a releasing of the camming relationship to thereby release the connection between the receptacle and the plug shell.

This releasing action has been produced by a segmenting of the coupling member in arcuate segments, which blossom outwardly upon movement of the operating sleeve to an axially retracted release position. An advanced position is in turn induced by the exertion of the separating force acting between the receptacle and the operating sleeve.

The separating force acts against compression springs which serve to urge the operating sleeve into an axial position in which it serves to confine the arcuate segments so as to prevent the outward releasing movement thereof.

The separating force is transmitted to compress the springs by means of a spring retainer housing which is axially secured to the plug shell by means of an anchoring radial lip or flange and on which the springs are caused to act by a retaining ring secured by a snap ring.

In prior art designs, the retainer housing was of one-piece construction which was anchored by a snap ring fit into a retaining groove on the plug shell in order to provide the necessary axial securement thereof.

Such arrangement entailed the cost of machining for the retaining ring groove as well as a difficult assembly procedure since the retainer housings were disposed within the operating sleeve and the point whereat the snap ring was to be assembled was well within.

Accordingly, this arrangement contributed significantly to the expense of manufacture of the electrical connector.

Accordingly, it is the object of the present invention to provide a releasing electrical connector of the type described in which the spring retainer housing is installed in axially anchored relationship with the plug shell without the need for installation of a separate retaining ring to thereby minimize the cost of manufacture and to simplify the assembly thereof.

SUMMARY OF THE INVENTION

This and other objects of the present invention, which will become apparent upon a reading of the following specification and claims, are achieved by an improved electrical connector of the type including an axially movable operating sleeve which secures the mating contact carrying connector bodies together, or allows separation force to the operating sleeve and one of the connector bodies, and movement of the operating sleeve to an axially shifted release position.

The operating sleeve is spring biased to the nonrelease position by a series of springs acting between the operating sleeve and a generally cylindrical spring retainer housing anchored to one of the connector bodies.

The improvement comprises a radial segmented spring retainer housing in which each of the segments is formed with a radially inward extending portion which together form an inwardly turned flange. This enables assembly of the housing into a recess on the associated connector body to create the necessary axial securement thereof without the necessity for the separate assembly of a snap ring retainer into a groove on the plug shell.

In the disclosed embodiment, the operating sleeve is axially movable against a plurality of compression springs disposed in aligned grooves in the operating sleeve and retainer housing and interposed between the bottom of the grooves in the operating sleeve and a retainer ring axially anchored to the spring retainer segments by a snap ring to be biased into the nonreleasing position. In the nonreleasing position, the operating sleeve confines an array of arcuate threaded coupling segments in engagement with corresponding thread forms formed on the other of the connector bodies. Rotation of the operating sleeve causes mating movement between the connector bodies by cooperation of the threaded internal coupling segments and the external thread on the other of the connector bodies. Upon the application of separating force to the other of the connector bodies and the operating sleeve, the operating sleeve shifts against the bias of the compression springs to the release position, with internal recesses formed. The operating sleeve, which allows each of the threaded coupling segments to move radially outward induced by the camming action of the threaded connection between the connector body and the threaded coupling segments.

The coupling segments are formed with exterior ramp surfaces which mate with surfaces formed on the operating sleeve recess to insure parallel outward releasing motion of the threaded coupling segments so as to enable guiding of the released connector body at the moment of release, which occurs upon sufficient outward radial movement of the segments to enable clearance of the thread forms on the connector body by the internal thread form of the coupling segments.

The connector bodies are retained in engagement by means of anti-vibration springs carried by threaded coupling segments and in engagement with the ratchet teeth formed on the exterior of the plug shell precluding the relative unthreading rotation between the threaded coupling segments and the threaded connector body.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
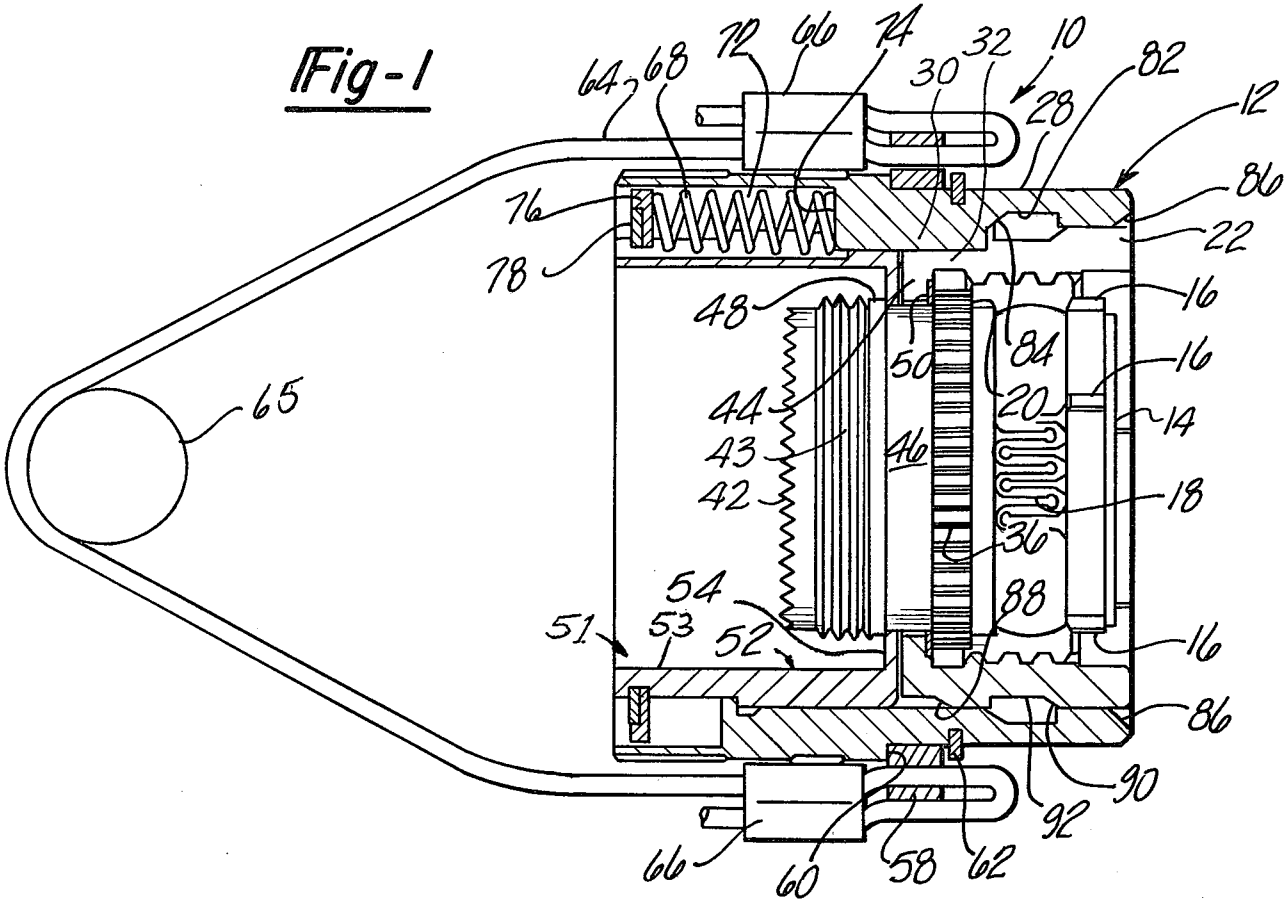
FIG. 1 depicts an electrical connector assembly according to the present invention in partial longitudinal section.

Referring to the drawings and particularly to FIG. 1, the releasing electrical connector 10 depicted includes an operating assembly 12, which mounts first and second contact carrying generally cylindrical connector bodies which are configured to be mated with each other by relative axial movement therebetween. In the embodiment shown, the connector bodies comprise plug shell 14 and a receptacle connector 15 (FIGS. 3 through 5), the receptacle connector 15 adapted to be received over the righthand end of the plug shell 14 as viewed in FIG. 1. Alignment keys 16 on the plug shell 14 are adapted to mate with corresponding keyways in the receptacle 15 so as to properly align the plug shell 14 in the receptacle, prior to electrical contact engagement.

Figure 3:
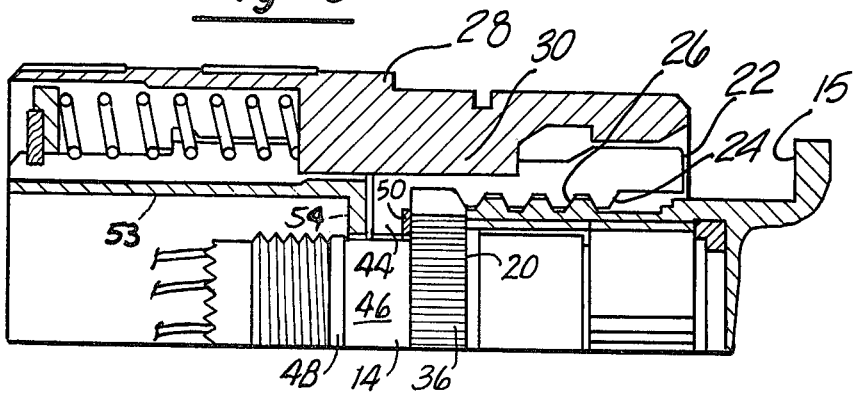
FIGS. 3 through 5 depict the electrical connector depicted in FIG. 1 in partial longitudinal section and in fragmentary form, including the installation of a corresponding receptacle connector body shown respectively in the fully connected/partially disconnected positions; and in a position just prior to separation of the receptacle connector and plug shell.
Figure 4:
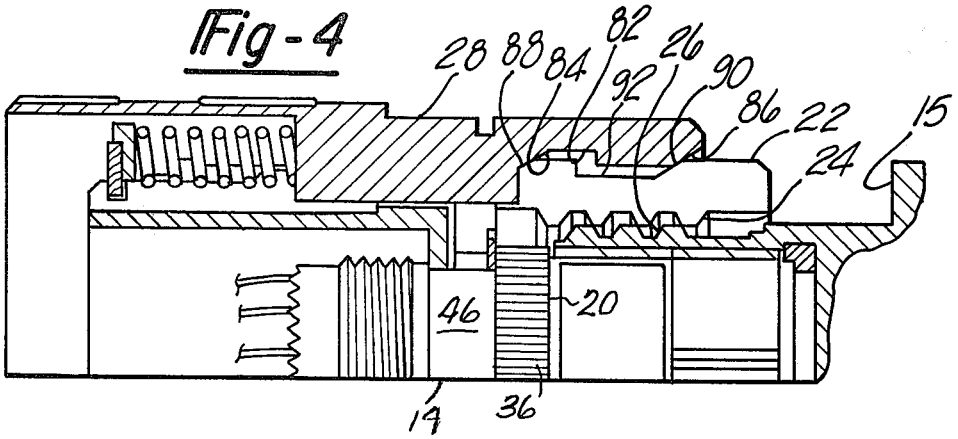
Figure 5:
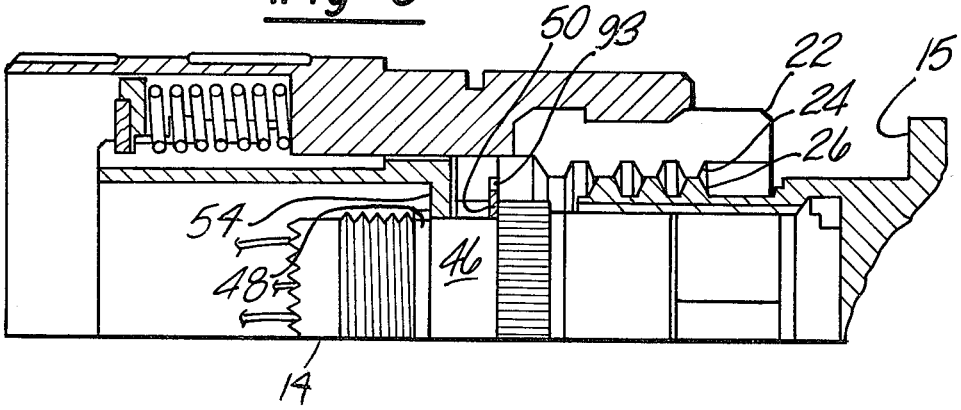

The receptacle connector 15, shown in fragmentary form in FIGS. 3 through 5, is received over the plug shell 14 in contact with a serpentine grounding strap 18, and in abutment against the radial face 20 as shown in FIG. 1.

An axial mating force is applied to the plug shell 14 and receptacle connector 15 by cam means provided by a threaded interengagement between the arcuate threaded coupling segments 22 which are formed with an internal thread form 24, and an external thread form 26 formed on the receptacle connector 15.

The arcuate threaded coupling segments 22 are rotated by an operating sleeve 28 rotationally connected to the arcuate threaded coupling segments 22 and plug shell 14. This rotational driving connection is provided by a series of keys 30 which extend into gaps between each of the arcuate threaded coupling segments 22, the gaps created by adjoining recesses 32 formed in each of the arcuate threaded coupling segments 22.

Rotation of the operating sleeve 28 thus causes corresponding rotation of the arcuate threaded coupling segments 22. Accordingly, upon positioning the receptacle connector 15 over the end of the plug shell 14 and rotation of the operating sleeve 28, the receptacle connector 15 is axially advanced in order to be mated with the plug shell 14.

There is also provided an anti-vibration arrangement which precludes backing off of the threaded engagement between the arcuate threaded coupling segments 22 and the receptacle connector 15, which consists of anti-vibration springs 34 which are mounted to the arcuate threaded coupling segments 22, so as to extend transversely to the radial direction and be urged into engagement with ratchet teeth 36 formed on the periphery of the plug shell 14.

Figure 2:
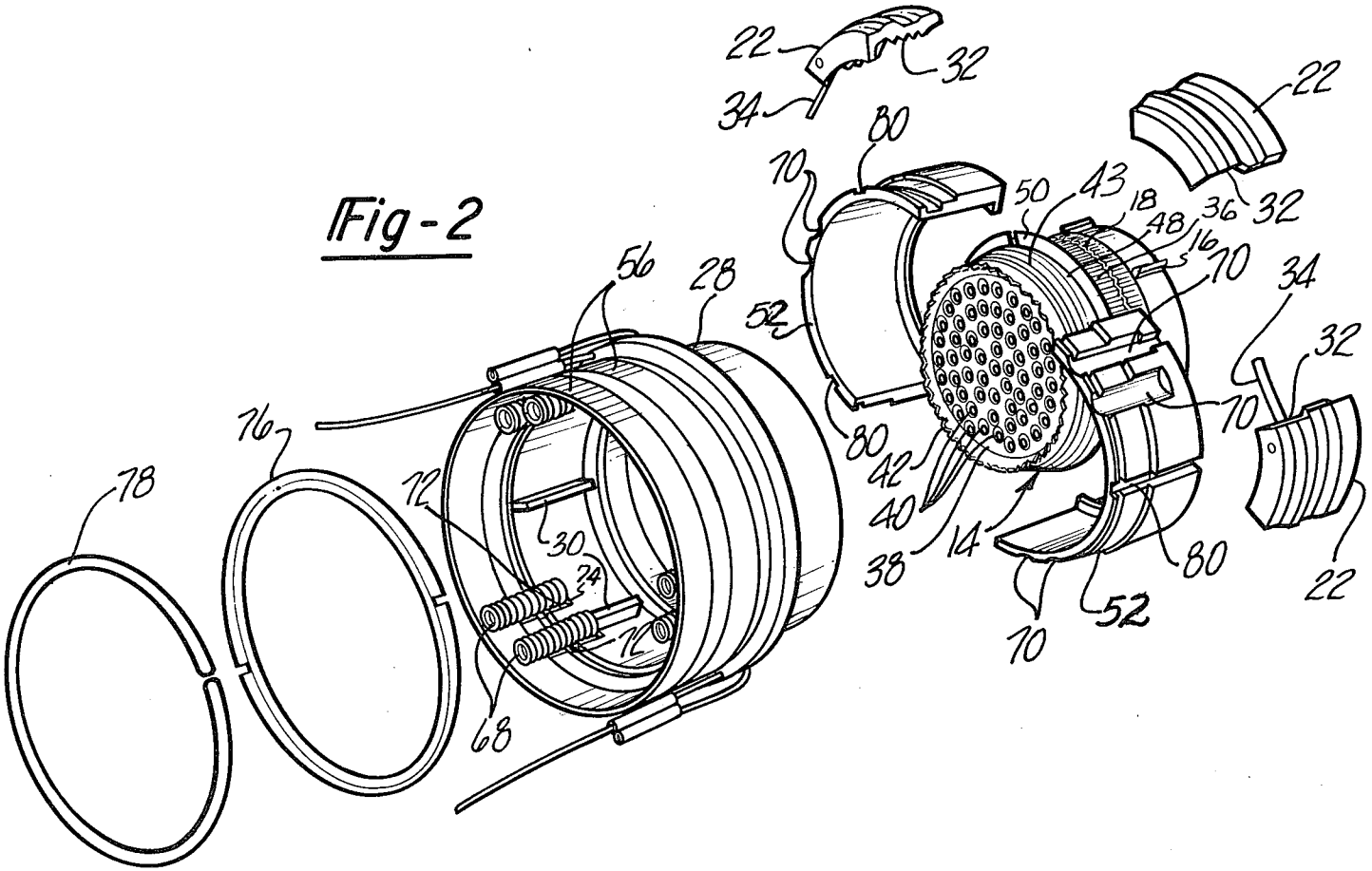
FIG. 2 depicts an exploded perspective view of the major components included in the electrical connector depicted in FIG. 1.

The direction of inclination of the anti-vibration springs 34 is so as to oppose relative rotation in the direction of unthreading (FIG. 2).

The opposite face 38 of the plug shell 14 is provided with a series of openings 40 in which are received the various electrical wires to be electrically connected by means of the electrical connector 10. A strain relief coupling (not shown) is normally employed which is received over a threaded section 42 of the connector and which comes into abutment with indexing axially facing teeth 43 which maintain the proper angular relationship between the strain relief coupling and the plug shell 14 in conventional fashion.

Each of the arcuate threaded coupling segments 22 are provided with an inwardly directed flange portion 44 which is received within a recess 46 formed in the plug shell 14 intermediate the ratchet teeth 36 and a flange 48 integrally formed on the plug shell 14.

A snap ring 50 is provided interposed between the ratchet teeth 36 and the inwardly directed flange portion 44 to absorb the thrusting engagement and which also maintains the axial position of each of the arcuate threaded coupling segments 22 during their in and out movement to be described, engaged with the plug shell 14 while relative rotation is allowed in a direction tending to advance the receptacle connector 15 into mated position.

Accordingly, rotation of the operating sleeve 28 moves the receptacle connector 15 axially with respect to the plug shell 14 to provide the coupling action.

The operating sleeve 28 is knurled at 56 in order to assist in the ease with which rotation thereof may be accomplished manually in order to produce the coupling action.

In the normal axial position of the operating sleeve 28 as depicted in FIG. 1, the threaded engagement of the arcuate threaded coupling segments 22 and the receptacle connector 15 also provides means for retaining the receptacle connector and the plug shell 14 in mating relationship.

As noted, the electrical connector 10 provides a releasing action upon the application of a separation force of a predetermined level to the operating sleeve 28 and to the receptacle connector 15. Towards this end, the operating sleeve 28 has mounted a retaining ring 58 secured against a shoulder 60 and a snap ring 62 so as to be axially affixed thereto. The retaining ring 58 in turn mounts and receives a loop of a lanyard cable 64 secured by being passed through openings formed in retaining ring 58 and fastened by means of cable connector sleeves 66.

The lanyard cable 64 in turn is looped over a fixed mandrel 65. A typical application is found in connectors applied for bomb racks, in which the mandrel 65 forms a part of the bomb rack, while the receptacle connector 15 is affixed to the bomb, such that upon release of the bomb a separating force is applied to the operating sleeve 28 and the receptacle connector 15.

The operating sleeve 28 thus is positionable in a first or nonreleasing position, wherein the plug shell 14 and receptacle connector 15 are axially retained to be in mating relationship; and in a second axially shifted position (relative the connector bodies) in which these elements are released for separation. Since such movement of the operating sleeve 28 is against the bias of spring means, a spring retainer housing 51 is required in order to transmit the force applied to the operating sleeve 28 through the spring means into the nonreleased connector body, i.e., the plug shell 14, and to secure the plug shell 14 to the operating sleeve 28 as an assembly. At the same time, the rotary motion of the operating sleeve 28 to provide mating movement of the receptacle connector 15 and the plug shell 14 must be accommodated.

According to the concept of the present invention, these requirements are provided by a retainer housing 51 of a radially segmented construction, in which the retainer housing 51 is formed of a plurality of retainer housing segments 52, two segments in the embodiment shown. Each retainer housing segment 52 is formed with a body portion 53 and a radially inwardly turned portion 54, which with the segments positioned together within the operating sleeve 28 and over the plug shell 14 form an annular inwardly extending flange.

The resulting flange is disposed within the recess 46 formed in the plug shell 14 so as to axially anchor the retainer housing 51 thereto.

The operating sleeve 28 is normally biased to the first or nonreleasing axial position shown in FIG. 1 by a plurality of compression springs 68 (six in the embodiment shown) which are received within axially extending spring pockets formed by aligned adjacent grooves, a first groove 70 being formed along the exterior of each of the retainer housing segments 52 and a corresponding second groove 72 being formed along the interior of the operating sleeve 28.

The righthand end of each of the compression springs 68 as viewed in FIG. 1 is positioned against a radial face 74, forming the bottom of the grooves 72. While the opposite or lefthand end of each of the compression springs 68 as viewed in FIG. 1 is engaged with a retaining ring 76 which in turn abuts a snap ring 78 axially secured to the body portion 53 of each of the retainer housing segments 52, the spring force acts on the retainer housing 51 and is transmitted into the plug shell 14 thereby. The segmented retainer housing 51 is also rotationally joined to the operating sleeve 28 so as to be rotated therewith as an assembly by the keys 30 formed in the inside of the operating sleeve 28 and which pass into keyways 80 formed in the outside diameter of each of the retainer housing segments 52.

This accommodates the rotation of the operating sleeve 28 relative the plug shell 14 while providing an axial securement through the compression springs 68.

It can be appreciated that the device may be easily assembled by simply positioning each retainer housing segment 52 with the inwardly turned portions 54 into the recess 46. Each of the arcuate threaded coupling segments 22 and the snap ring 50 are assembled at the same time.

The operating sleeve 28 is then slid over the outside of each of the arcuate threaded coupling segments 22 and the spring retainer housing 52 with the keys 30 providing the necessary alignment and rotational connection. The compression springs 68 may then be inserted into the pockets formed by the grooves 70 with retaining ring 76 added and the snap ring 78 inserted which may be relatively easily done since it is adjacent the rear face of the connector.

Accordingly, it can be appreciated that the provision of the split housing 54 substantially simplifies the manufacturing of the device since a separate snap ring groove may not be required and the relatively difficult assembly step of inserting a snap ring into the internal bore and the inside diameter of the retainer housing segments 52 is avoided.

Thus, the axial force applied to the receptacle connector 15 is transmitted into the operating sleeve 28 such as to create a reaction force resisted by the lanyard cable 64 and establish the decoupling forces by virtue of the flange formed in each of the retainer housing segments 52, as well as through the mating thread forms on the receptacle connector 15 in each of the arcuate threaded coupling segments 22 which allows the compression spring 68 to be compressed by relative axial movement to the operating sleeve 28 and the rest of the assembly, including the arcuate threaded coupling segments 22.

The releasing action afforded by the axial movement will be understood by those skilled in the art, but is here described in the interest of completeness.

The inside bore of the operating sleeve 28 is formed with a recess 82 having a ramping surface 84 formed thereon and a second corresponding spaced apart ramping surface 86 provided at the end face as indicated in FIG. 1.

The exterior of each of the arcuate threaded coupling segments 22 is provided with corresponding spaced ramping surfaces 88 and 90 and an intermediate clearance recess 92 positioned therebetween.

Upon relative axial movement of the operating sleeve 28 from the non-releasing position (shown in FIG. 3) and to an axially shifted position as shown in FIG. 4, external thread forms 26 create an outward radial movement of each of the arcuate threaded coupling segments 22 due to the ramping action on the side flanks of the tooth form, which outward radial motion is accommodated by the alignment of the recess 82 and forward ramping surface 84 with the portion of each of the arcuate threaded coupling segments 22 adjacent the ramp surface 88 and the clearance recess 92.

Ramping surfaces 84, 86, 88 and 90 are axially spaced and maintain each of the arcuate threaded coupling segments 22 in a generally parallel condition to the axis of the coupling and particularly to the outside diameter of the external thread form 26 in order to provide a guided separation of the receptacle connector 15 from the arcuate threaded coupling segments 22 after arcuate segments have moved to the radial position at which separation is allowed, i.e., to the fully expanded position shown in FIG. 5.

Thus, separation will occur as the next step in the sequence since the thread forms 24 and 26 have been moved relatively radially sufficiently to enable passage of the external thread form 26 past the arcuate threaded coupling segments 22.

The spaced ramp surfaces are fully seated in this position and continue to maintain the fully parallel condition. After separation, the compression spring 68 moves the operating sleeve 28 back into its retracted axial position which cams each of the arcuate threaded coupling segments 22 back inwardly into the initial position. The in and out movement is guided by means of the snap ring 50 seated within a clearance recess 93 in engagement with the keys 30 between the recesses 32 formed on each side of the arcuate threaded coupling segments 22 to thus return the components to their initial position and ready to receive the receptacle connector 15.

The embodiments of the invention in which an exclusive property or privilege is claimed are defined as follows:

1. A releasing electrical connector comprising:

a first electrical contact carrying connector body;

a second electrical contact carrying connector body movable into mating engagement with said first connector body by relative axial movement therebetween;

one of said first or second connector bodies being formed with a recess;

an operating sleeve received over said mated first and second connector bodies;

means for retaining said first and second connector bodies in axially mated relationship when said operating sleeve is in a first axial position relative thereto;

means for releasing said first and second connector bodies from mated relationship by axial disconnecting movement of said operating sleeve to a second axial position relative to said first axial position;

means for biasing said operating sleeve into said first axial position, said means comprising a segmented retainer housing having at least two retainer housing segments positioned together within said operating sleeve and about one of said first or second connector bodies, each of said retainer housing segments including an annular body section having a transverse portion turned radially inwardly, said transverse portions being positioned together and forming an inwardly turned flange with said retainer housing segments, said flange extending into said recess on said one of said first or second connector bodies; and a spring, the spring acting on said retainer housing and said operating sleeve and resisting the axial movement of said operating sleeve from said first to said second axial position, whereby a separating force applied to said operating sleeve and said other of said first or second connector bodies sufficient to overcome said spring bias action produces release of said connector bodies.

2. The electrical connector according to claim 1 wherein said retainer housing flange portions have a radial surface disposed adjacent to said means for retaining the connector bodies in axially mated relationship and secure said retainer housing axially while accommodating relative rotation between the housing and the connector bodies.

3. The electrical connector according to claim 2 wherein each of said first and second connector bodies and said operating sleeve are generally cylindrical and wherein said operating sleeve and said segmented retainer housing are rotationally connected while allowing the relative axial movement therebetween by means of a keyed connection between said operating sleeve and each of said segments of said segmented retainer housing.

4. The electrical connector according to claim 2 wherein the exterior surface of said segmented retainer housing is provided with longitudinally extending first grooves, wherein said operating sleeve is provided with second grooves corresponding to and aligned with the first grooves and wherein a compression spring is disposed within each of said aligned grooves.

5. The electrical connector according to claim 4 further including a snap ring carried by said retainer housing and restraining one end of each of said compression springs and wherein said operating sleeve is formed with radial end faces formed in said operating sleeve at the end of each of said grooves and the other ends of said compression springs engage said radial end faces.

6. The electrical connector according to claim 1 wherein said means releasing said first and second connector bodies for relative axial disconnecting movement comprises a plurality of arcuate coupling segments interposed between said operating sleeve and said other of said first or second connector bodies, the interior surface of each of said arcuate segments adjacent said other of said connector bodies formed with cam surfaces mating with cam surfaces formed on said other of said connector bodies with said operating sleeve in said first axial position, said means further including mating surfaces formed on each of said arcuate coupling segments and the outside portion thereof and the interior of said operating sleeve moving said arcuate coupling segments radially inward with said operating sleeve in said first position to produce a mating relationship of said cam surfaces formed on said interior surface of said arcuate segments and the exterior of said other of said first or second connector bodies, and in said second axially shifted position of said operating sleeve allowing outward radial movement of each of said arcuate coupling segments, whereby in said outward radial position thereof said camming surfaces disengage to allow disconnecting axial movement of said other of said connector bodies.

7. The electrical connector according to claim 6 wherein each of said arcuate coupling segments is formed with a radially inward portion thereof, and wherein said one of said first or second electrical bodies recess also receives said radially inward portion of said arcuate coupling segments.

8. The electrical connector according to claim 7 wherein said cam surfaces comprise mating thread forms formed respectively on said interior of said inside coupling segments and the exterior of said second connector body, and further including means creating a rotational driving connection between each of said arcuate coupling segments and said operating sleeve, whereby upon rotation of said operating sleeve, said other of said first or second connector bodies is axially advanced into engagement with said one of said first or second connector bodies.

9. In a releasing electrical connector of the type comprising a first electrical contact carrying connector body; a second electrical contact carrying body movable into mating engagement with said first connector body by relative axial movement therebetween; one of said first or second connector bodies being formed with a recess; an operating sleeve received over said mated first and second connector bodies; means for axially retaining said first and second connector bodies in said mated relationship when said operating sleeve is in a first axial position relative thereto; means for releasing said first and second connector bodies for relative axial disconnecting movement when said operating sleeve is in a second axial position shifted relative to said first axial position; means for biasing said operating sleeve into said first axial position, said means including a spring acting on said operating sleeve to resist axial movement of said operating sleeve from said first to said second axial position, the improvement comprising:

a segmented retainer housing comprised of at least two retainer housing segments disposed within said operating sleeve and about one of said first or second connector bodies, each of said retainer housing segments including an annular body section having a transverse portion turned radially inwardly, said transverse portions together forming an inwardly turned flange with said retainer housing segments positioned together within said operating sleeve, said flange disposed extending into said recess on said one of said first or second connector bodies, said spring also acting on said retainer housing whereby a separating force acting on said connector bodies is transmitted through said spring means into said operating sleeve.

* * * * *